United States Patent [19]

Smal

[11] Patent Number: 4,739,151

[45] Date of Patent: Apr. 19, 1988

[54] ELECTRICALLY HEATING HAIR STYLING TONGS SELECTIVELY USABLE TO CRIMP OR STRAIGHTEN HAIR

[75] Inventor: Henri Smal, Blegny, Belgium

[73] Assignee: S. A. Faco, Hersta, Belgium

[21] Appl. No.: 937,540

[22] Filed: Dec. 3, 1986

[30] Foreign Application Priority Data

Dec. 6, 1985 [LU] Luxembourg ..... 86196

[51] Int. Cl.[4] ..... H05B 1/00; A45D 1/04; A45D 1/14

[52] U.S. Cl. ..... 219/225; 132/31 R; 132/32 R; 132/37 R; 132/118; 219/228; 219/230

[58] Field of Search ..... 219/222–226, 219/228, 230; 132/31 R, 31 A, 32 R, 32 A, 37 R, 37 A, 7, 9, 117, 118

[56] References Cited

U.S. PATENT DOCUMENTS 943,321 12/1909 Shero ..... 132/32 A
2,419,777 4/1947 Howe ..... 219/222 X

FOREIGN PATENT DOCUMENTS 172581 2/1905 Fed. Rep. of Germany ..... 219/222

*Primary Examiner*—Anthony Bartis
*Attorney, Agent, or Firm*—Karl F. Ross; Herbert Dubno

[57] ABSTRACT

An electric hair styling tong includes a pair of elongated arms pivotally articulated to each other at one end and each carrying at its other end an electrically heated pad arranged with its face confronting the face of the other pad and with the face of one pad being smooth for hair straightening and the face of the other being undulating for hair crimping. An intermediate arm movably mounted between the articulated arms carries an intermediate plate provided on on side with a smooth face selectively engageable smooth pad face and on the opposite side with an undulating face complementary to and selectively engageable with the undulating pad face. The intermediate arm may be selectively latched to one or the other of the articulated arms to maintain either the confronting undulating faces or the confronting two smooth faces in engagement, enabling the other of the confronting smooth or undulating faces to be used to treat the hair. The intermediate arm may be simultaneously latched to both of the articulated arms for storage of the tongs.

3 Claims, 2 Drawing Sheets

ELECTRICALLY HEATING HAIR STYLING TONGS SELECTIVELY USABLE TO CRIMP OR STRAIGHTEN HAIR

FIELD OF THE INVENTION

The present invention relates to electric hair styling tongs of the type consisting of two articulated arms and each comprising a heated pad or shoe.

BACKGROUND OF THE INVENTION

In the known hair styling tongs, according to whether the heated pads are either flat or undulated, it is possible either to straighten the hair or to crimp it.

OBJECT OF THE INVENTION

The object of the present invention is to combine both possibilities in a single appliance. To achieve this end, it is advantageous according to the invention to provide a pair of electric hair styling tongs characterised in that between the articulated arms thereof there is an intermediate plate having a flat face and an undulating face and adapted to be fixed rigid with one or the other of the heated pads having a similar face.

SUMMARY OF THE INVENTION

According to the invention, the intermediate plate is carried by an arm provided with latching means adapted to engage either with engagement means provided on the inner face of one of the two articulated arms or with engagement means provided on the inner face of the other of the two articulated arms.

Again according to the invention, the latching means provided on the intermediate arm is capable of simultaneously engaging the engagement means provided on both articulated arms for storage of the tongs.

BRIEF DESCRIPTION OF THE DRAWING

So that the invention may be better understood, it will now be described in greater detail on the basis of the appended drawings which are given solely by way of example and in which.

SPECIFIC DESCRIPTION

Figure 1:
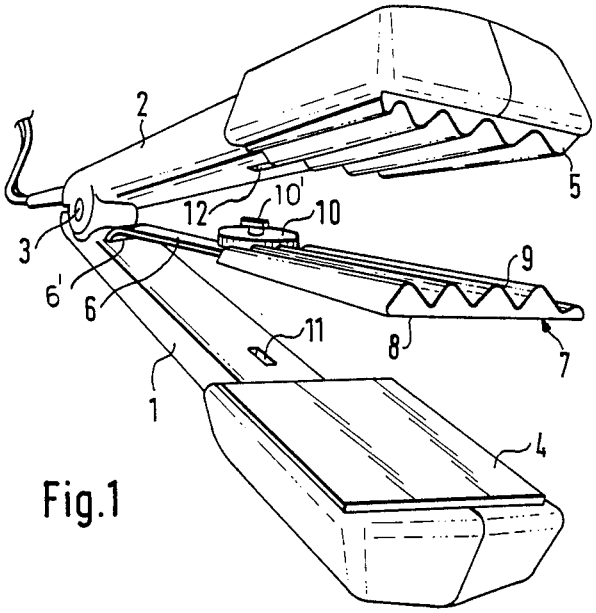
FIG. 1 is a perspective view of a pair of electric hair styling tongs according to the invention with the intermediate plate in a neutral position.

The pair of electric hair styling tongs shown in FIG. 1 are of the type consisting of two arms 1, 2 articulated about a pivot 3, each of the arms 1, 2 comprising heated pads 4 and 5, each heated by a standard electrical resistance element disposed in a respective recess 4.1 and 5.1 of pads 4 and 5 and 5'.

According to the invention, the two pads 4, 5 are not identical, that is, one pad 4 is smooth while the other pad 5 has an undulating surface.

Between the two articulated arms 1, 2 there is an intermediate arm 6 carrying a plate 7 of which one face 8 is smooth and faces the smooth pad 4 while the other face 9 is undulating and faces the undulating pad 5 so that the two undulating surfaces fit one into the other.

Figure 2:
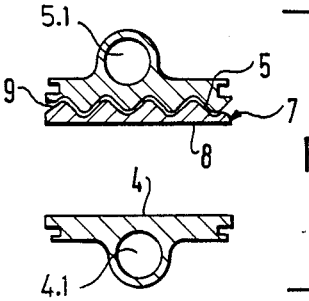
FIG. 2 is a cross-section through the tongs shown in FIG. 1 in a position ready for straightening the hair.
Figure 3:
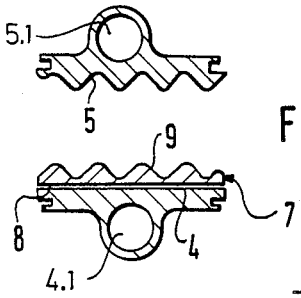
FIG. 3 is a section similar to that shown in FIG. 2 in a position where the tongs are ready for crimping the hair.

The intermediate arm 6 is mounted on arm 1 at 6' and is provided with means 10 adapted to be latched either with means 11 provided on the arm 1 or with means 12 provided on the arm 2 when the arm 6 is swung into contact with either arm 1 or 2 respectively in such a way that either the two undulating surfaces (FIG. 2) or the two smooth surfaces (FIG. 3) may engage each other.

According to whether the face 8 or 9 of intermediate plate 7 is engaged with one or the other of the plates 4, 5 carried by the articulated arms 1, 2, the hair styling tongs act as crimpers (FIG. 3) or as hair straighteners (FIG. 2) and it is possible to change from one system to the other quickly and while the tongs are in use.

Latching the intermediate arm 6 with either one or the two articulated arms 1, 2 can be carried out by a click-stop engagement, a slideway, a rotary locking device 10; magnetised shoes or any other appropriate system of connection.

To avoid improper manipulations, the latching means can be designed in such a way that the plate 7 of intermediate arm 6 cannot come free from the articulated arm 1 or 2 to which it is latched. The illustration in a neutral position shown in FIG. 1 is given only to facilitate understanding.

Furthermore, the latching means can also be designed in such a way so as to provide a position which latches the intermediate arm 6 simultaneously to the two articulated arms 1 and 2 in order to keep the hair styling tongs closed for storage.

Figure 4:
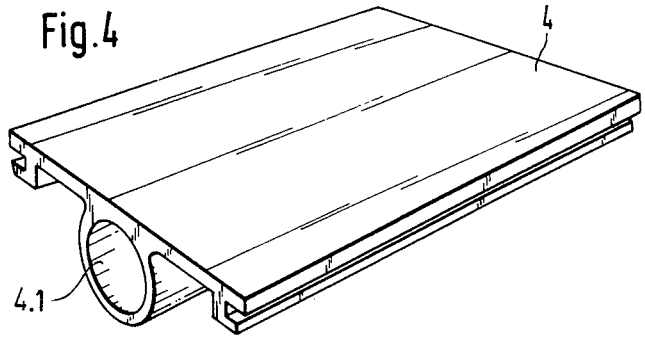
FIG. 4 is a perspective view of the heating pad used for straightening hair.
Figure 5:
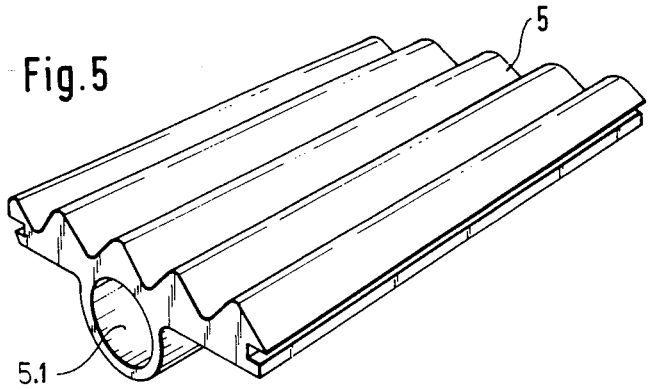
FIG. 5 is a perspective view of the heating pad used for crimping hair.
Figure 6:
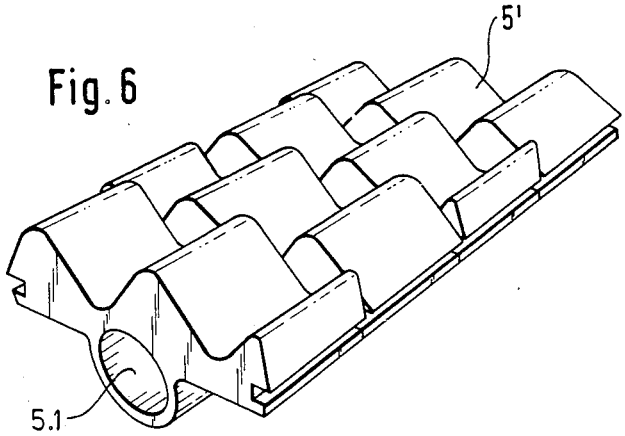
FIG. 6 is a perspective view of another embodiment of the heating pad used for crimping hair.

With a pair of hair styling tongs according to the invention, it is envisaged to employ for the pads and the intermediate plate any profile or shape suitable for hairdressing, such as a smooth face, an undulating face, a face with offset undulations etc. Such pads (smooth 4, undulating 5 or offset undulations 5') are shown in FIGS. 4 to 6.

It should be noted that all manipulations of the tongs are carried out from the closed tongs position.

I claim:

1. Electric hair styling tongs comprising:

two elongated arms pivotally articulated to each other at one end and which carry at their other end a pair of electrically heated pads having confronting faces, the face of one pad being smooth and the face of the other pad being undulating;

an intermediate plate movably mounted between said pair of heated pads, said intermediate plate being provided on one side with a smooth face adapted to be selectively engaged with the pad having the smooth face and an opposite side with an undulating face complementary to said undulating face of the other heating pad and adapted to be selectively engaged therewith; and latching means for selectively fixing the intermediate plate to one or the other of the two articulated arms to maintain either the two undulating faces or the two smooth faces in engagement, thereby enabling the other of the smooth or undulating faces to be used to treat the hair.

2. The styling tongs defined in claim 1 wherein said intermediate plate is carried at a free end of an elongated intermediate arm mounted at the other end thereof on either of said articulated arms, said latching means being mounted on said intermediate arm, and respective engagement means formed on each articulated arm and selectively engageable by said latching means for fixing said intermediate plate and arm to one or the other of said articulated arms.

3. The styling tongs defined in claim 2 wherein said latching means mounted on said intermediate arm is adapted to engage each engagement means simultaneously, whereby both articulated arms are kept in engagement with said intermediate plate for storing said tongs.

* * * * *